United States Patent [19]

Hannan et al.

[11] Patent Number: 4,632,218

[45] Date of Patent: Dec. 30, 1986

[54] SLIDING DESCENT DEVICE

[76] Inventors: Randy R. Hannan, 5137 S. Whipple, Chicago, Ill. 60632; Timothy E. Mulcahy, 2650 W. 85th St., Chicago, Ill. 60652

[21] Appl. No.: 778,397

[22] Filed: Sep. 20, 1985

[51] Int. Cl.[4] ..... A62B 1/16; A62B 35/00

[52] U.S. Cl. ..... 182/5; 188/65.2

[58] Field of Search ..... 182/5-8, 182/193; 188/65.1-65.5

[56] References Cited

U.S. PATENT DOCUMENTS

| | | | |
|---|---|---|---|
| 785,202 | 3/1905 | Dahlquist | 188/65.3 |
| 2,561,514 | 7/1951 | Houseman | 188/65.2 |
| 3,179,994 | 4/1965 | Meyer et al. | 182/5 |
| 3,437,178 | 4/1969 | Postlethwait | 182/5 |
| 3,852,943 | 12/1974 | Healy | 182/5 |
| 3,876,036 | 4/1975 | Sweet | 188/65.2 |
| 4,385,679 | 5/1983 | Mulcahy | 182/5 |
| 4,474,262 | 10/1984 | Himmelrich | 182/5 |
| 4,546,851 | 10/1985 | Brennan | 182/7 |

*Primary Examiner*—Reinaldo P. Machado

*Attorney, Agent, or Firm*—Mason, Kolemainen, Rathburn & Wyss

[57] ABSTRACT

A sliding descent device for controlling the movement of a user sliding down a rope includes a generally cylindrical housing containing a tubular channel member defining an axial rope path extending through the housing. The device can be installed on a medial segment of a rope without threading an end of the rope through the housing by opening a closure structure and admitting the rope to the axial rope path through a lateral rope entry path. The closure structure is moved to a closed position to capture the rope in the axial path. A brake member is mounted for movement relative to the housing into the axial rope path to apply a braking force to the rope. A first control member supports the weight of the user and moves the brake member to increase the braking force to halt the device. A second control member is manually operated to move the brake member and reduce the braking force for a sliding descent. The mechanical advantage of the first control member is varied by selecting one or more attachment positions so that the device may be used by one or more persons of various weights.

11 Claims, 9 Drawing Figures

20
34
92
90
94
36
42
40
22
66
80
82
30
26
84
24
58
52
44
54
50
48
28
56
110
108
68
102
70
78
76
74
104
32
100
62
98
96
46
60
64
88
86
106A
94
90

SLIDING DESCENT DEVICE

The present invention relates to siding descent devices and more particularly to improvements in devices permitting a user safely to descend a rope in a controlled manner.

Sliding descent devices may be used for various purposes, a primary example being the escape from a high rise building in the event of fire. A sliding descent device makes it possible for a user to descend along a rope from an elevation higher than can be reached by conventional equipment such as ladders. It is extremely important that sliding descent devices used in these and other circumstances be sturdy and reliable and easy to operate and control even under crisis conditions. It is also desirable that such a device be capable of attachment to a rope without threading the rope through the device, and that the device be able to support more than one person and safely to support an incapacitated person.

U.S. Pat. No. 4,385,679 discloses a sliding descent device intended for the same general purpose as the present invention. In that device, a rope must be threaded through the housing and cannot be inserted laterally into the rope receiving channel. In addition, the device disclosed in that patent has a single lever controlling the application of the braking force, and the braking force is not controlled by the weight of the user nor can it effectively be used by different numbers of persons or persons of widely different weights. It is one important object of the present invention to provide a sliding descent device including improvements over the device disclosed in that United States patent.

U.S. Pat. No. 3,179,994 discloses a safety appliance adapted to clamp upon a cable to prevent falling by a workman climbing an elevated structure or tower. While it is not necessary to thread a cable through that appliance, disassembly of the appliance is necessary to attach it to a medial portion of the cable. Moreover, that appliance is not concerned with controlled sliding descent of a user.

Among the objects of the present invention are to provide a sliding descent device capable of being easily attached to a medial portion of a rope without disassembly of the device; to provide a sliding descent device usable by a single person or more than one person and usable by persons of widely differing weights; to provide a sliding descent device including two different control mechanisms for locking the device on a rope in response to the weight of a user and for manually reducing the braking force to achieve a safe, controlled descent; and to provide a sliding descent device overcoming disadvantages of devices used in the past.

In brief, the above and other objects and advantages of the present invention are achieved by providing a sliding descent device having a housing and a rope receiving channel defining an axial rope path extending axially through the housing. A brake member is movable with respect to the housing and into the channel for applying a braking force to a rope. A lateral rope entry path permits a medial segment of a rope to enter the channel, and a closure structure is mounted for movement on the housing between a closed position blocking the lateral entry path and capturing the rope in the channel and an open position in which the lateral entry path is unobstructed. Two different control members are coupled to the brake member. The first includes provision for supporting the weight of one or more users of various weights, and controls the brake member to lock the device on a rope if, for example, the user is incapacitated. The second control member is manually operable by the user to diminish the braking force and to permit a controlled sliding descent along the rope.

The present invention together with the above and other objects and advantages may be best understood from the following detailed description of the preferred embodiment of the invention shown in the accompanying drawings, wherein.

Figures 1, 2, 3:
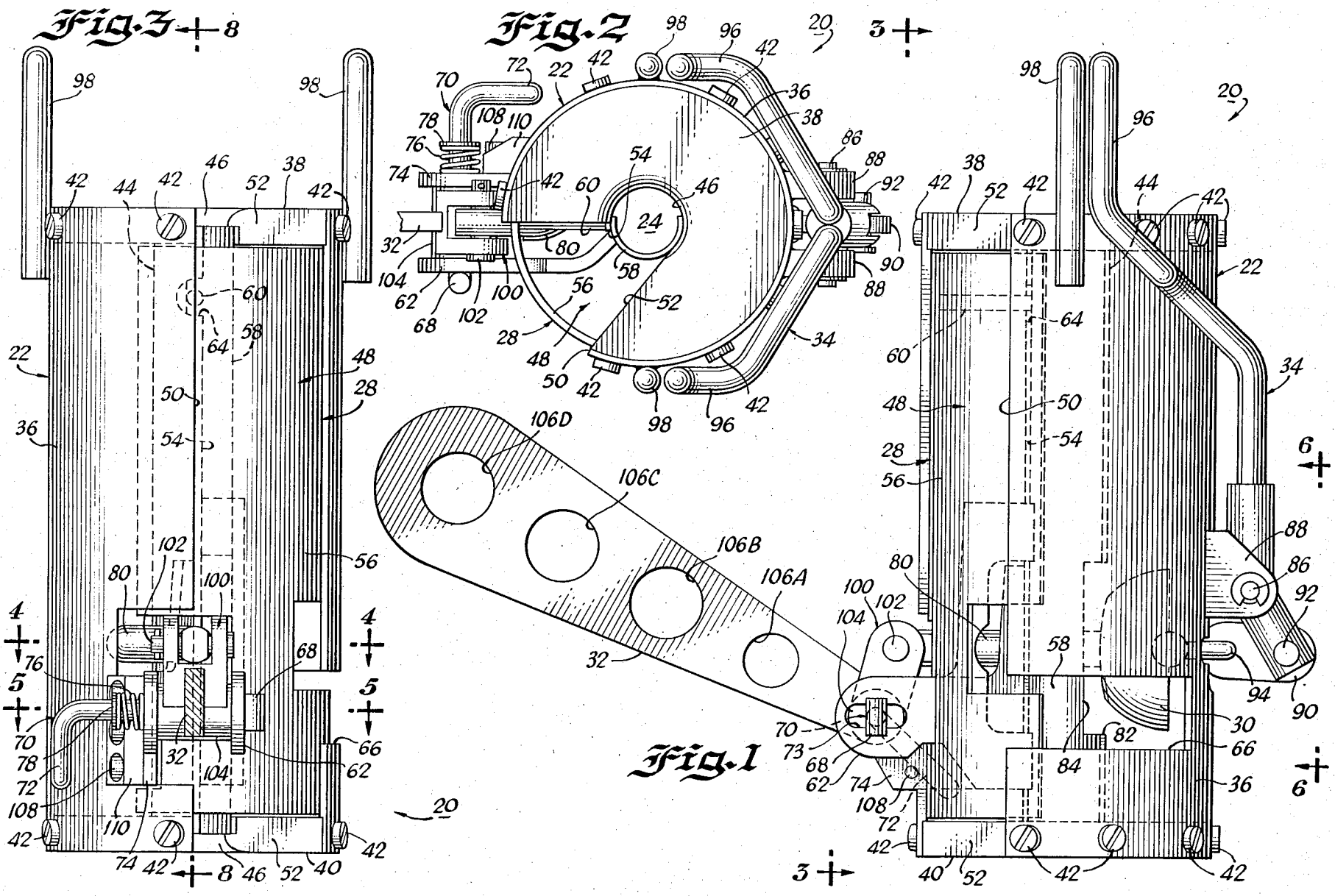
FIG. 1 is a side elevational view of a sliding descent device constructed in accordance with the present invention.
FIG. 2 is a top view of the device.
FIG. 3 is a side view of the device taken from the line 3—3 of FIG. 1.
Figures 4, 5, 6, 7:
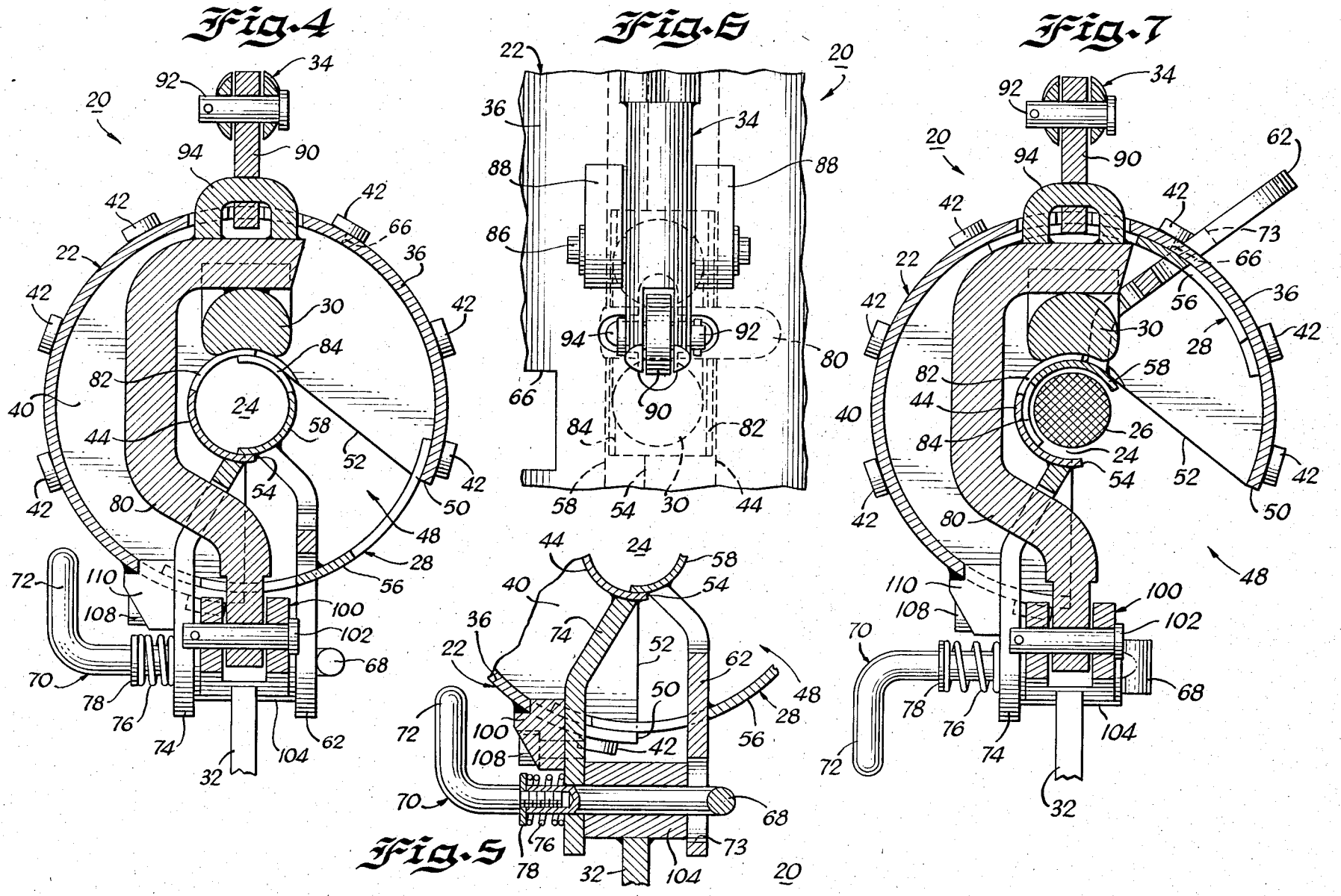
FIG. 4 is a cross sectional view of the device taken along the line 4—4 of FIG. 3 and showing the device in a stand-by condition prior to attachment to a rope.
FIG. 5 is a fragmentary sectional view taken along the line 5—5 of FIG. 4.
FIG. 6 is a fragmentary side view taken from the line 6—6 FIG. 1.
Figures 8, 9:
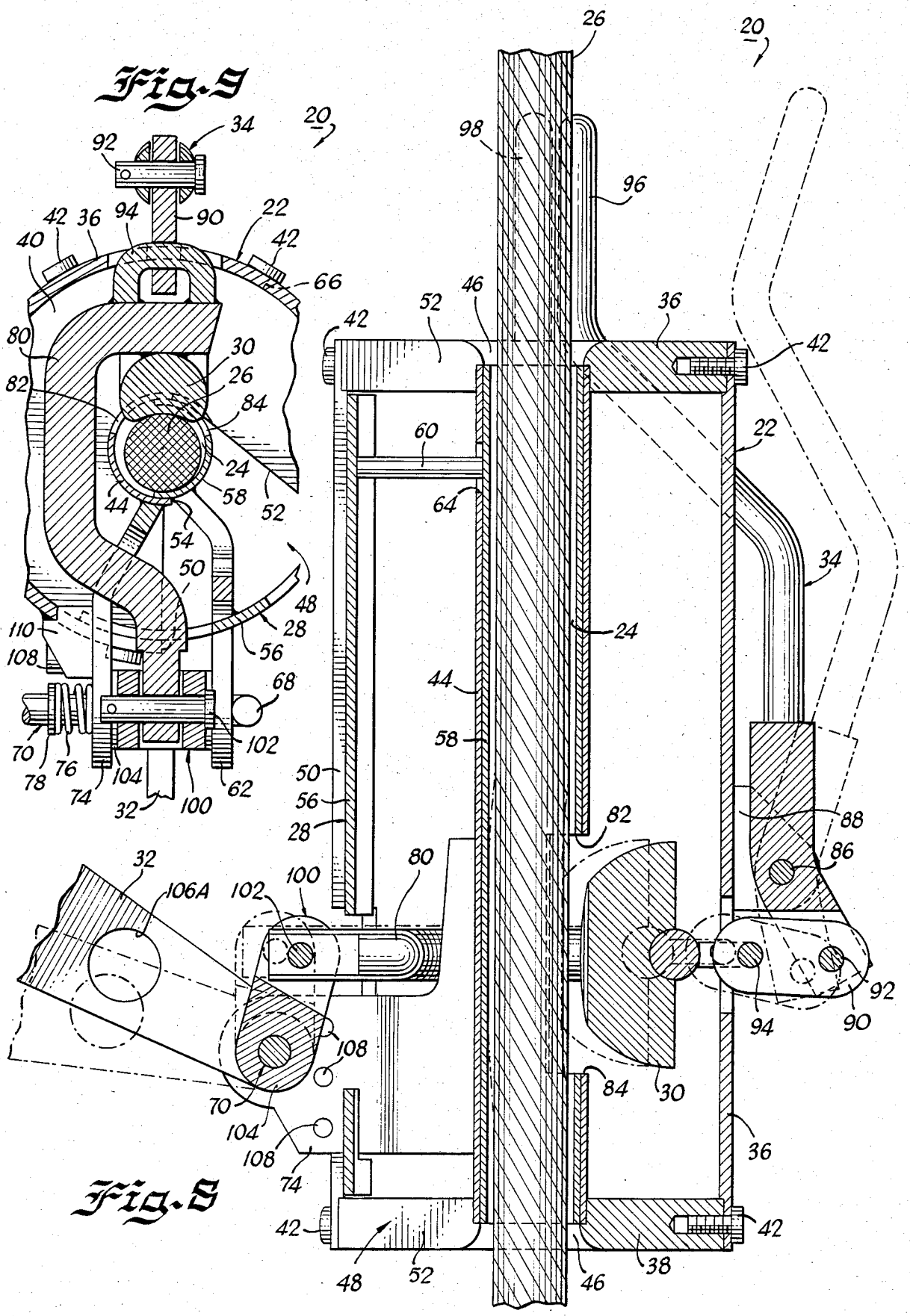

FIG. 7 a sectional view similar to FIG. 4 illustrating the position of the components of the device as the device is attached to a medial segment of rope;

FIG. 8 is a sectional view on an enlarged scale taken along the line 8—8 of FIG. 3 and illustrating the device after attachment to a rope; and FIG. 9 is a fragmentary sectional view similar to a portion of FIG. 4 illustrating the device with a braking force applied to a rope.

Referring now to the drawings there is illustrated a sliding descent device designated as a whole by the reference numeral 20 and constructed in accordance with the principles of the present invention. In general, the sliding descent device 20 includes a housing 22 within which is a channel 24 defining a path through which a rope 26 (FIGS. 7–9) may travel relative to the device. A closure structure generally designated as 28 may be moved relative to housing 22 to permit a medial segment of rope 26 to enter the channel 24. A brake member 30 is controlled by a locking lever 32 and by a control lever 34 either to lock the device 20 on rope 26 or to permit a safe and controlled sliding descent.

Proceeding to a more detailed description of the device 20, housing 22 is generally cylindrical in shape and includes a cylindrical side wall 36 concentric with the rope channel 24. A top end plate 38 and a bottom end plate 40 are securely attached to the top and bottom ends of side wall 36 in any suitable way, fasteners 42 being used in the illustrated embodiment.

Channel 24 is defined within an elongated tube 44 concentric with the side wall 36. Tube 44 extends between the top and bottom end plates 38 and 40 and is rigidly secured or captured in position. Each end plate includes a central, axial opening 46 aligned with tube 44 so that the rope channel 24 extends throughout the entire axial length of the device 20. Openings 46 may be flared as illustrated to prevent damage to rope 26. The channel is shaped to accept different sizes of rope, such as seven-eighths inch or three-quarters inch diameter. The device may be used with ropes and cables of various types and the term "rope" as used in this description and the following claims is not restricted to any particular type.

In accordance with one important feature of the present invention, the rope 26 need not be threaded through the device 20. Consequently, the device can be attached to a medial section of a rope, such as a rope already in place and extending near a window of a burning building. This advantage is achieved by means of a lateral rope entry path 48 defined in the housing 22 and channel 24.

More specifically, housing side wall 36 includes an axially extending opening 50 throughout its length. End plates 38 and 40 each include a radially extending, generally pie-shaped opening 52 each extending from the opening 50 in the side wall 36 radially inward to the central openings 46 in the end plates 36 and 38. Tube 44 includes an axially extending opening 54 throughout its length, and opening 54 is aligned with the openings 52 and 50. As best seen in FIG. 7, the lateral rope entry path 46 is defined by the openings 50, 52 and 54.

During use of the device 20 and in a standby or ready condition prior to use, the lateral rope entry path is blocked by the closure structure 28. Structure 28 includes a cylindrical outer wall 56 concentric with and in telescoped relation with side wall 36 of the housing 22. A cylindrical inner wall 58 of the closure structure 28 is concentric with and in telescoped relation with the tube 44 and therefore cooperates with tube 44 in defining the rope channel 24. Walls 56 and 58 move as a unit and are interconnected by a support brace 60 (FIG. 8) and by a generally radially extending support plate 62. In the normal or stand-by condition of the device 20, the closure structure 28 blocks the lateral rope entry path 48. In this position (FIGS. 1–4), the outer wall 56 closes the opening 50 in side wall 36 and the inner wall 58 closes the opening 54 in the tube 44.

Closure structure 28 is movable relative to housing 20 without disassembly of the device 20 to an alternate open position to permit attachment of device 20 to a medial rope segment. In the open position as illustrated in FIG. 7, outer wall 56 rotates away from opening 50 in the housing side wall 36 and inner wall 58 similarly rotates away from opening 54 in tube 44. In this open position, the device 20 can easily be placed in position on rope 26 without the necessity for threading the rope through the device. When the rope is received in the channel 24, the closure structure 28 is returned to its closed position and the rope 26 is captured within channel 24 so that relative movement between the device 20 and the rope 26 is limited to the axial direction.

A slot 64 in tube 44 (FIG. 8) permits the brace 60 to move in the circumferential direction as the closure structure 28 is moved between its open and closed positions. Similarly, a slot 66 in the housing side wall 36 accommodates circumferential movement of the support plate 62.

The closure structure 28 is locked in its closed position by a head 68 of a latch pin 70 including an angled handle portion 72. Normally, pin 70 is pivotally mounted in an opening or slot 73 in support plate 62 and in an aligned opening in a second support plate 74. A spring 76 captured between plate 74 and an abutment 76 on pin 70 provides tension normally holding latch pin 70 in its locked position with the handle portion 72 inclined toward housing 22 as shown in broken lines in FIG. 1. In this position, the head is transverse to the slot 73. When the handle portion is pivoted to its alternate position (FIG. 7) the head 68 is aligned with slot 73 and the closure structure 28 can be moved to its open position by grasping and rotating the projecting outer end of the support plate 62. Reclosing and locking of the closure structure 28 is accomplished by moving the plate 62 in the opposite direction and by returning the latch pin 70 to its locked position.

Brake member 30 is part of a unitary fabricated assembly including a formed brake link member 80 movable generally in a plane transverse to the axis of the housng 22. Brake member 30 is in the form of a shoe welded to the link 80 and is movable from a disengaged position (FIG. 4) toward an engaged position (FIG. 9) through a window provided in rope channel 24 by slots 82 and 84 aligned in the tube 44 and the inner wall 58 of the closure structure 28. When the brake member 30 is moved radially inwardly as shown in FIG. 9, it enages rope 26 in the channel 24 to create a braking force capable of slowing movement of the device 20 along rope 26 or of locking the device 20 in a fixed position along the rope.

In accordance with an important feature of the present invention, the brake member 30 may be controlled by the locking lever 32 in order to lock the device 20 on the rope 26. Alternatively, the brake member 30 may be controlled by the control lever 34 to reduce the braking force for a safe, controlled descent.

Control lever 34 is coupled to the brake member 30. Lever 34 is pivoted with respect to the housing 22 by a pin 86 received in openings in a pair of mounting plates 88 attached to the sidewall 36, for example by welding. The lowermost end of lever 34 is offset and is connected to a link 90 by a pivot pin 92, and the link 90 is in turn connected to the brake link 80 by a formed, U-shaped link 94 having its ends attached as by welding to the brake link 80 in the region directly opposite the brake member 30.

A pair of bifurcated handle portions 96 of the lever 34 extend upwardly and around the housing 22 so that one end portion or handle 96 is easily accessible at each side of the top of the housing. The portions 96 serve as hand levers in cooperation with a pair of fixed handles 98 extending upwardly from the opposite sides of the top of the housing 21. The length of the lever 34 in cooperation with the linkage interconnecting the lever and the brake member 30 provide substantial mechanical advantage when the handles 96 are pulled by a user toward the fixed handles 98.

Locking lever 32 is also coupled to the brake member 30. From the region of brake member 30, the brake link 80 extends around the side of the rope channel 24 and through the front portion of the housing 22. The forwardmost end of the brake link 80 is connected to the opposed legs of a clevis 100 by a pivot pin 102. Clevis 100 is part of an integral fabrication also including a cylindrical spool portion 104 and the locking lever 32. Spool portion 104 is pivotally mounted on the latch pin 70 so that when the locking lever 32 is moved downwardly (counterclockwise in FIG. 1) the brake member 30 is moved into the rope channel 24 and against the rope 26.

In use, the locking lever 32 serves to clamp or lock the device 20 to a rope 26, while the control lever 34 is manipulated by a user to partially release the brake member 30 to reduce braking force and permit descent along the rope. Thus, the lever 32 and the lever 34 constitute two different control members acting with an opposite effect upon the brake member 30.

More specifically, and referring now to the operation of the device 20, the device is first attached to a rope 26. In the manner indicated above, this attachment may be accomplished to a medial section of the rope spaced from its ends by opening the closure structure 28 and permitting the rope 26 to enter the rope channel 24 through the lateral rope entry path. Once the rope is in place, the closure structure 28 is reclosed and latched in position with the head 26 of the latch pin 70.

After the device 20 is installed upon a rope, the user is suspended from the locking lever 32. In accordance with a feature of the invention, the lever 32 includes a series of different openings 106A–D located at different distances from the pivot axis defined by the latch pin 70. This permits the user to select one of a number of different mechanical advantages and permits the device 20 to be used effectively with persons of widely differing weights or with more than one person.

When a single person uses the device 20, the weight of the user is suspended from one of the holes 106. For example, a harness, belt or rope may be fixed to a selected one of the holes 106A–D. Since the holes are different distances from pin 70, each hole 106 provides a different mechanical advantage. A lighter individual might use hole 106D, while a heavier individual might use hole 106C.

In the case of descent by more than one person, two different holes 106 may be employed. For example, one person may attach to hole 106A and the weight of that person will have relatively less effect on the brake member 30. The other person may attach to one of the more distant holes such as 106C or 106D. Since device 20 is intended to be used either by one person or by more than one person, the term "user" as employed in this description and in the appended claims is not intended to have the restricted meaning of a single person.

After the user is suspended from locking lever 32 by attachment of a suitable harness, belt or rope to one of the holes 106, the weight of the user causes brake member 30 to clamp against rope 26. This locks or fixes the device 20 in a stationary position on rope 26. This provides a "dead man" locking function so that if a user of the device loses consciousness or becomes incapacitated, the device 20 safely holds that person stationary on the rope until rescue can be effected.

The stationary position is illustrated in broken lines in FIG. 8. Here the locking lever 32 has been pivoted downwardly due to the weight of a user and the brake member 30 is firmly in contact with the rope as also shown in FIG. 9. The movable handles 96 of the control lever 34 are pivoted away from the fixed handles 98.

In order to begin a safe and controlled descent along the rope 26, the user grasps one or both of the handles 96 and pulls them toward the fixed handles 98. Through operation of the link 90 and U-shaped pin 94, this retracts the brake member 30 to reduce the force applied to rope 26 and reduce the braking force. The braking force can readily be modulated and controlled, even by an inexperienced user, to achieve a gradual and safe descending motion.

The effect of the locking lever 30 and of the control lever 34 are in opposition as regards movement of the brake member 30. While the user's weight tends to stop the device 20, grasping of the handles 96 tends to permit its movement. This provides a number of desirable advantages. One advantage is that an automatic "dead man's" lock results without relying on a snubbing or wedging action of a single lever which depends unduly on uncontrolled factors such as rope friction and variations due to dirt, grease, rain or the like.

Another advantage is that the degree of locking force varies proportionally with the weight of the user for any selected hole or holes 106. Thus, the heavier the user weight, the greater the locking force so that even when two large adults use the device 22, it is reliably locked in position until such time as the handles 96 are manipulated. Moreover, since the force required to operate handles 96 to decrease braking force is proportional to the weight of the user, the mechanism is self-regulating to a certain extent since, for example, a heavy adult can be expected to be stronger than a relatively light child.

The tube 44 and the inner wall 58 of the closing structure 28 need not themselves be strong enough to carry the reaction forces applied through rope 26 by the brake member 30. The brace 60 and the support plate 62 reinforce the inner wall 58 by transferring forces from the inner wall to the outer wall 56 which itself is reinforced by the sidewall 36 of the housing in which it is telescoped. The inner wall 58 is also reinforced by the tube member 44 in the region opposite the brake member 30. That portion of tube member 44 is strengthened by the fixed support plate 74. As best seen in FIGS. 3–5, plate 74 is attached by screws 108 to a support block 110 welded to the sidewall 36 to provide a firm and rigid assembly.

While the invention has been described with reference to details of the preferred embodiment illustrated in the drawing, these details are not intended to limit the scope of the invention as defined in the following claims.

What is claimed and desired to be secured by Letters Patent of the United States is:

1. A sliding descent device for controlling movement down a rope comprising:

a housing;

a rope receiving channel within said housing and defining an axial rope path extending axially through said housing;

said housing including a generally cylindrical side wall, said channel being defined within a tubular member supported coaxially within said side wall, a brake member movable with respect to said housing and into said channel for applying a braking force to a rope in said axial path;

a lateral rope entry path extending radially through said side wall and tubular member throughout the axial extent of said housing from said channel to the exterior of said housing and permitting a medial rope segment to move radially relative to said housing from the exterior of said housing into said axial path; and a closure structure mounted for movement with respect to said housing between a closed position wherein said lateral entry path is blocked and an open position wherein said laterial entry path is unobstructed;

said closure structure including a tube segment coaxial with and in telescoped rotational relationship with said tubular member and including a cylindrical segment coaxial with and in telescoped rotational relationship with said side wall;

2. A sliding descent device as claimed in claim 1 further comprising a latch member supported by said housing for selectively locking said closure structure in said closed position.

3. A sliding descent device as claimed in claim 2, said brake member being disposed radially between said side wall and said tubular member.

4. A sliding descent device as claimed in claim 3, said latch member comprising a latch pin mounted for rotation on said housing.

5. A sliding descent device as claimed in claim 4, further comprising brake control means coupled to said brake member and including linkage means pivotably mounted on said latch pin.

6. A sliding descent device for controlling movement down a rope comprising:

a housing;

a rope receiving channel within said housing and defining an axial rope path extending axially through said housing;

a brake member movable with respect to said housing and into said channel for applying a braking force to a rope in said axial path; and first and second control members mounted for movement relative to said housing and coupled to said brake member for controlling the braking force;

said first member including means for supporting the weight of a user and said second member including a manually operable control element.

7. A sliding descent device as claimed in claim 6, said first member being movable to increase the braking force in response to the application of user weight.

8. A sliding descent device as claimed in claim 7, said second member being movable to decrease braking force in response to manual control.

9. A sliding descent device as claimed in claim 8, further comprising first and second connecting means coupled respectively between said brake member and said first and second members.

10. A sliding descent device as claimed in claim 6, said supporting means including means for varying the effective mechanical advantage between said first member and said brake member.

11. A sliding descent device as claimed in claim 10, said varying means comprising a plurality of different user attachment positions located on said second member.

* * * * *